United States Patent [19]

Nilsson

[11] 4,040,762

[45] Aug. 9, 1977

[54] DEVICE AT ROAD ROLLER

[76] Inventor: Mats Åke Nilsson, Taftea, Sweden, 91035

[21] Appl. No.: 649,418

[22] Filed: Jan. 15, 1976

[30] Foreign Application Priority Data

Jan. 17, 1975 Sweden ..... 7500490

[51] Int. Cl.[2] ..... E01C 19/26

[52] U.S. Cl. ..... 404/129; 172/547

[58] Field of Search ..... 404/129, 122, 123; 172/547

[56] References Cited

U.S. PATENT DOCUMENTS

| | | | |
|---|---|---|---|
| 1,722,907 | 7/1929 | Liddle | 404/129 |
| 2,134,883 | 11/1938 | Moore | 404/129 X |
| 2,197,183 | 4/1940 | Keeler | 404/129 |
| 2,830,511 | 4/1958 | Wills | 404/129 X |
| 3,875,666 | 4/1975 | Cline | 404/129 X |

*Primary Examiner*—Nile C. Byers

*Attorney, Agent, or Firm*—Pierce, Scheffler & Parker

[57] ABSTRACT

A water distributing arrangement attached to a road roller to prevent material from adhering to the roller's surface includes a curvilinear mat supported in contact with the roller's surface and extending for its entire width. Water is distributed to the roller's surface through the mat's interior from a spray tube extending for the length of the mat and is prevented from flowing out in an axial direction at the mat's ends over the opposite ends of the roller.

15 Claims, 12 Drawing Figures

DEVICE AT ROAD ROLLER

Figure 1:
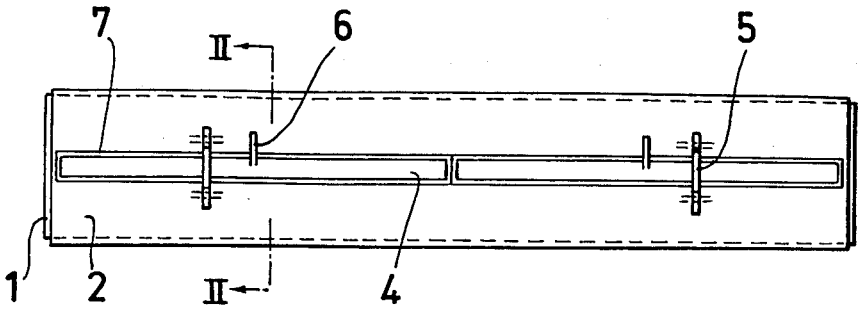

This invention relates to a device at road rollers and particularly at vibrating rollers in order to prevent bituminous and other adhesive road surface materials, such as for example asphalt and other materials, e.g. materials stabilized by cement, from adhering to the roll surface of a roller, and also in order to remove the material possibly adhering to said surface during the compaction work.

At asphalting and similar paving work it is for several reasons absolutely necessary that the paving mass is compacted, i.e. rolled, within some minutes after it was spread. The rollers used for compacting the spread mass, therefore, must be very reliable in operation and have a relatively long running time, i.e. the rollers must be capable of continuous operation for a relatively long period without unnecessary interruptions. These requirements, however, are not met on a satisfactory manner, neither with static rollers nor with the more efficiently compacting vibrating rollers, because there are great problems with both said roller types to maintain the roll surface clean of adhering material. Such material, if it is not removed, gives rise to uneveness in the surface being compacted. In order to remove such material from the roll surface, the roller must be stopped, which implies many unnecessary interruptions of the compacting work. In order to prevent such adhesion, heretofore scrapers were used in combination with means, such as sprinkler tubes, for watering the rolls and by using coir mats or the like for distributing the water. These scrapers and watering systems, however, were not capable to efficiently keep the rolls clean, a.o. because of unsatisfactory water distribution over the entire roll surface. The water consumption, moreover, has been so high at the conventional water distribution systems that is necessitated repeated fill-ups of water and, consequently, interruptions of the compacting work.

The coir mats used as water distributors in said water distribution systems not only have so poor scraping properties, that special scrapers of steel must be applied to remove adhering material from the roll surface, and by their design and structure contribute to the high water consumption, but they also have the disadvantage of getting worn rapidly and, thus, having to be exchanged frequently, which also can result in interruptions of the compacting work. The coirs, furthermore, serve no direct prupose when the roller is driven in one direction, for example when it is reversed.

The present invention, therefore, has the object to eliminate to the greatest possible extent these disadvantages and thereby the causes of the many interruptions of the compacting work occurring at the rollers used for such compacting work, and, thus, to bring about at such rollers a device, which is in an efficient manner by satisfactory water distribution over the whole surface of the roll to prevent paving material and the like from adhering to the roll surface, and which at the same time renders possible continuous operation of the roller during long periods without interruptions caused by water fill-ups and exchange of water distributor. A further object of the invention is to bring about a device of the kind referred to in the above introductory portion which operates equally efficiently irrespective of whether the roller is driven in the forward or rearward direction.

These objects are achieved thereby that as water distributor is used a mat abutting the roll surface and extending over the whole width thereof, which mat is provided with means preventing water from a spray tube attached in connection to the mat to flow in axial direction over the edges of the roll surface. Said means may be designed as projecting flaps at the upper long side of the mat or as a slit or a row of apertures in the mat, preferably in its centre, or as pocket-forming ridges on the mat surface facing toward the roll. In this latter case, the mat serving as water distributor acts equally efficiently irrespective of whether the roller is driven forward or rearward. Such efficient watering in both rotation directions of the roller roll can be achieved also by positioning a mat of said described kind on each side of a spray tube serving as water supply means, and preferably also on each side of the roll crest, in such a manner, that water is supplied to the slitted space between two mats by means of said spray tube, which in the latter case is positioned straight above the roll crest.

Figure 2:
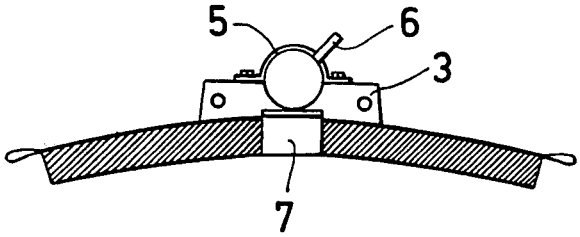
Figure 3:
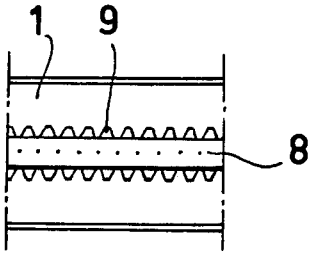
Figure 4:
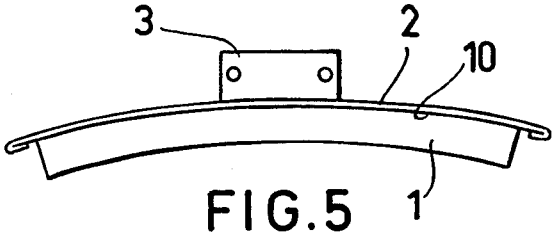
Figure 5:
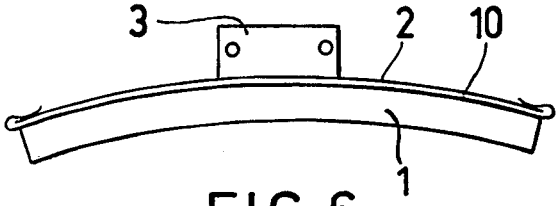
Figure 7:
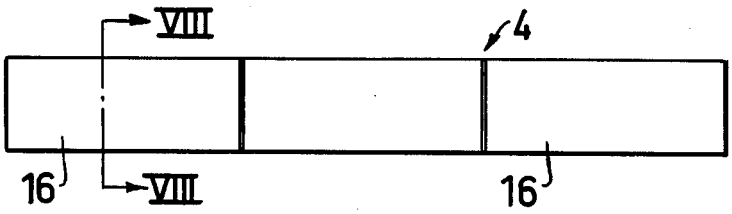
Figure 8:
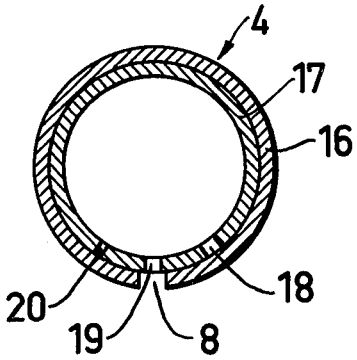
Figure 9:
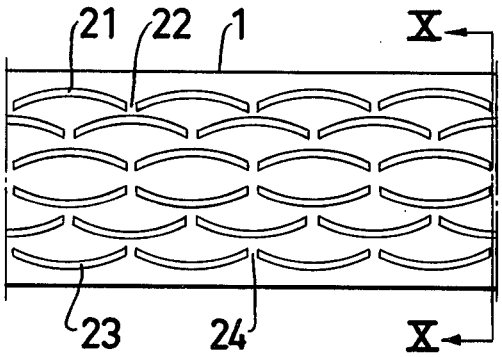
Figure 10:
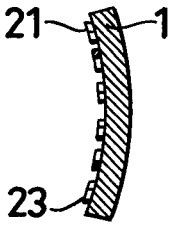
Figure 11:
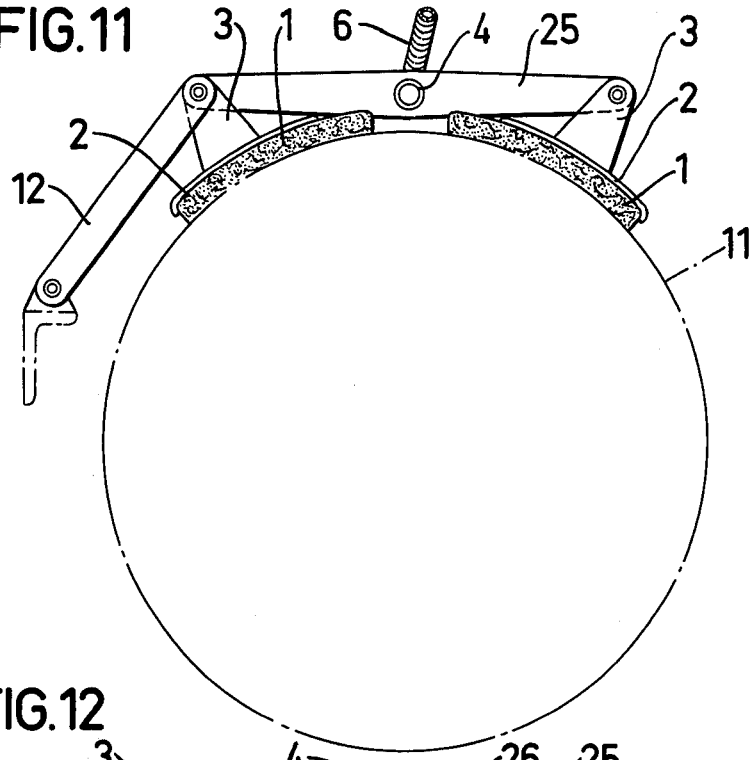
Figure 12:
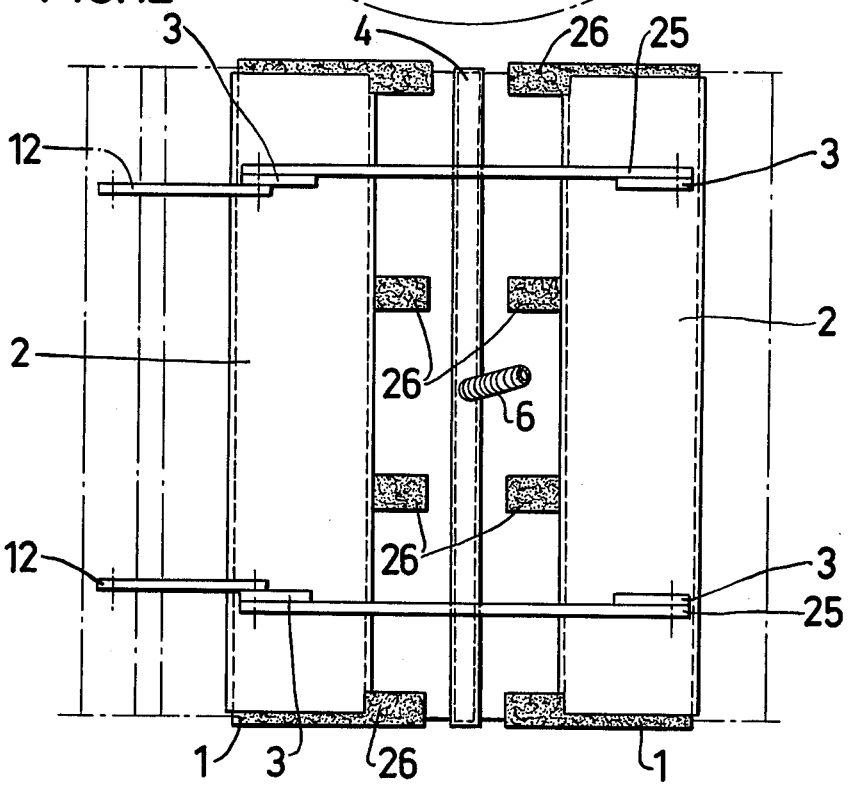

Further characterizing features of the invention become apparent from the following detailed description of some embodiments of the invention selected as examples, and from the accompanying drawings, in which:

FIG. 1 is a view from above of the device according to the invention in a first embodiment, FIG. 2 is on an enlarged scale a section along the line II–II in FIG. 1, FIG. 3 is a view from below of a portion of a slightly modified embodiment of the mat used as water distributor in the device according to the invention, FIG. 4 and 5 are an end view each of alternative embodiments of a holding means for said mat, FIG. 7 shows the device according to the invention applied on a roller roll, FIG. 7 shows in a schematic manner a modified embodiment of a spray tube comprised in the device and serving as water supply means, FIG. 8 is on an enlarged scale a section along the line VIII—VIII in FIG. 7, FIG. 9 is a view from below of a portion of a further modified embodiment of the mat serving as water distributor, FIG. 10 is a section along the line X—X in FIG. 9, FIG. 11 is a cross-section through a roll shown in a schematic manner with a further modified embodiment of the scraper, watering and water distribution device according to the invention, and FIG. 12 is a view from above of said device.

Figure 6:
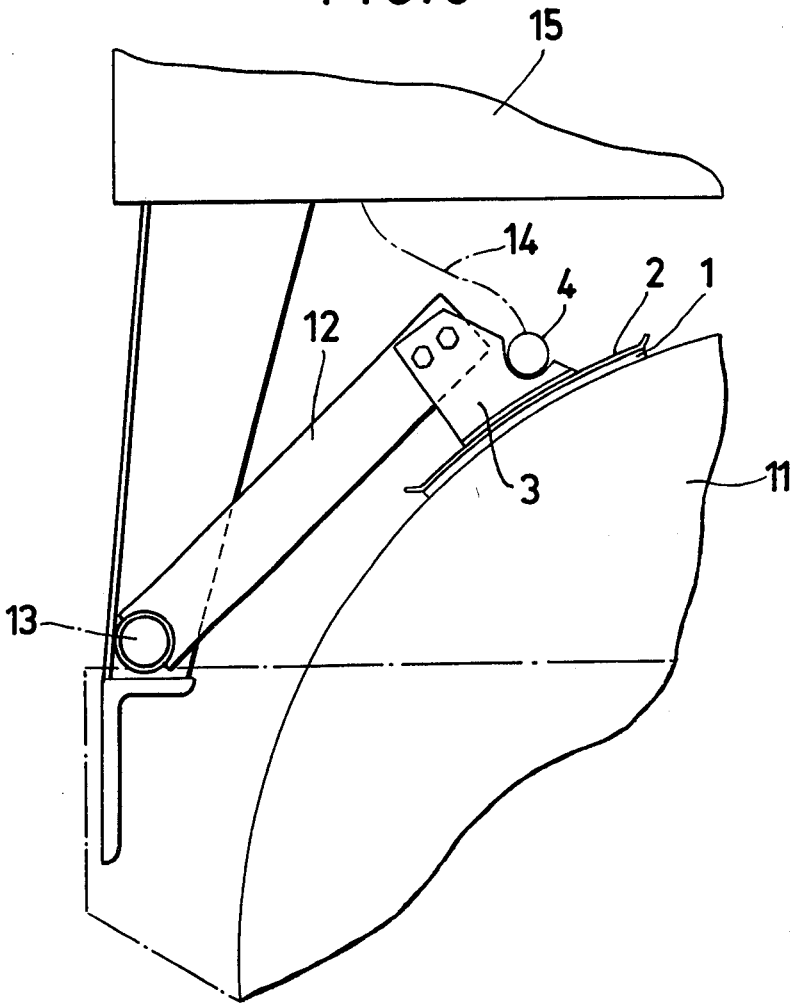

In the drawings, 1 designates a mat to abut with or without external pressure the shell surface of a roller roll over the whole of its width, as illustrated in FIG. 6 where 11 designates the roller roll. The mat 1 is connected to a holder 2,3 supporting on its upper side a spray or sprinkler tube 4 provided with apertures 8 and serving as means for supplying water to the shell surface of the roller roll 11. Said sprinkler tube 4 is connected via a conduit, only schematically indicated in FIG. 6, to a water tank 15 mounted on the roller, and the water flow to the sprinkler tube 4 can be controlled in a manner known per se by a valve means (not shown) actuated from the driver's seat.

The mat 1 at the embodiments shown in FIGS. 1–6 is glued onto a steel sheet 10 so curved that the mat 1 assumes the same curvature as the shell surface of the roller roll. The sheet 10 may have, as shown in FIG. 4, projecting flanges 16 intended to be inserted into folded end portions of the holder 2, whereby the mat 1 easily can be pushed into the holder and, when required, be exchanged. In FIG. 5 the flanges 16 of the sheet 10 are folded to form a guide groove for the holder 2. It is, thus, also at this embodiment possible rapidly to remove the mat for cleaning or exchange purposes.

Said mat 1 can be provided with apertures arranged one after the other in a row in the longitudinal direction of the mat or, as shown in FIGS. 1–3, with a slit 7 extending in said direction. The slit, which should be as long as possible, is closed at its ends so as to form a water pool or container for the water running down from the spray tube 4, which in FIGS. 1–3 is shown located straight above the slit 7, via corresponding apertures in both the holder 2 and sheet 10. By said water pool formed by the slit 7 in the mat 1 the excess water, i.e. the water not passing through between the mat and the shell surface of the roller roll, is retained, and as the slit 7 is closed at its ends no water can flow out in axial direction from the roll, even if the roll is inclined. The mat portion between the slit end and mat edge, however, may on its lower surface be provided with a small notch, so that also this surface of the roller roll 11 is supplied with water in a satisfactory manner.

In FIG. 3 the slit is shown provided with pockets 9 of hook-shape which are located centrally between the apertures 8 in the spray tube 4 and thereby ensure a satisfactory spray of the water. The pockets 9 also serve for retaining water and preventing it from running in axial direction, even in the case of a somewhat inclined roller. In the case of vibrating rollers said pockets preferably are designed undercut, so that the water is retained in spite of the vibrations. For this purpose, the slit 7 may also be provided with a water-absorbing and water-pervios material, for example foamed plastic or the like, which entirely must fill the slit 7. This material also prevents the water in the slit from running in axial direction on the roll surface and, besides, renders it possible that the water is distributed uniformly over the whole roll surface.

The spray tube 4, which in the embodiment according to FIGS. 1–6 by means of a clasp 5 lies secured in the holding iron 3 on the holder 2, is shown to consist of two pieces, or is closed at the centre, whereby a uniform water distribution also at inclined position of the roller is obtained. 6 designates inlets to the two sections of the two-piece spray tube 4.

In FIGS. 7 and 8 an alternative spray tube 4 is shown, which consists of an inner tube 17 and a number of separate outer sleeves 16 provided with the apertures 8 of the spray tube, which sleeves are arranged individually rotatable on the inner tube 17 and cover the same completely. Said inner tube 17 is provided with apertures 18,19 and 20 of different sizes and positioned in the same radial plane as the apertures 8 in the sleeves 16. Due to the rotatability of the sleeves, thus, the apertures 8 can be set directly in front of one of the apertures 18,19 and 20, whereby the water supply from the different sections of the spray tube 4 can be controlled individually. It is also possible to position the apertures 8 in the inner tube and the apertures 18,19,20 in the sleeves 16 for obtaining the same section-wise control of the water supply to the roll surface.

The mat 1 preferably is assembled of vulcanized rubber pieces and/or pieces of another elastomer material, in such a manner, that a coarse structure and a water-pervious surface is obtained. The coarse structure is of great importance, because the mat thereby shows in its lateral surface facing toward the roller roll 11 cavities, which are capable to receive and retain water, which is not required for forming a thin water layer over the whole roll surface, and which cavities can give off water, if necessary. Hereby, the water spray obtained is at maximum, and the water consumption can be maintained at minimum. Also the water pool 7 contributes thereto in an extraordinary manner. The mat being assembled of vulcanized pieces of an elastomer material, said coarse structure is maintained also at proceeding wear of the mat, due to the fact, that after a certain wear said pieces loosen from the mat and thereby form new cavities. The mat thus assembled has a long life, which can be increased by admixing at the manufacture of the map chips of metal or another relatively wear-resistant material. The metal chips also improve the scraping properties of the mat.

FIGS. 11 and 12 show a modified embodiment of the device according to the invention which comprises two water distributing mats 1 spaced from each other. The space between the edges of the mats facing toward each other form the slit 7. Each mat 1 is rigidly mounted on a metal sheet 2, which at their respective ends are equipped with holders or lugs 3. Said lugs are hingedly connected in pairs by means of an arm 25 oriented perpendicularly to the roll axis, and said arms 25 at the same time are support means for the spray tube 4, which via the connection 6 communicates with a water container (not shown) mounted on the roller. This embodiment, like the embodiment according to FIG. 6, is supported and held in position on the roller roll 11 by means of a pair of arms 12 pivotally fastened on the roller frame, for example with the help of rubber bushings 13 as shown only in FIG. 6, so that the water distributing mat and the associated spray tube 4 can be pivoted upward, when required. The mats 1 in the illustrated embodiment of the invention are shown abutting the roller roll by the own weight of the device, but they can also be pressed against the roll by spring forces or the like. It is further to be observed that the device according to the invention can be positioned on the roll crest, as shown in FIGS. 11 and 12, or on each side thereof, as shown in FIG. 6, irrespective of which embodiment is concerned.

In order to prevent that at the embodiment according to FIGS. 11 and 12 the water supplied to the roll surface from the spray tube 4 flows out over the roll edge when the roller is driven on a ground inclined in lateral direction, the upper long sides of the two mats facing toward each other are provided with a plurality of flaps 26 directed to each other, of which only the end flaps must lie directly in front of each other. When these mats are intended to be positioned to the side of the roll crest (see FIG. 6), the end flaps must have such a length as to leave no space between them. When water from the spray tube 4 flows down on the roll surface, the water upon rotation of the roll is collected by the forward mat 1, in the driving direction of the roller, and lies as a wave along the upper edge of the mat. The flaps prevent the water from flowing in axial direction and thereby contribute to maintaining the water distributed as uniformly as possible over the axial length of the roll even when the roll rolls on a support inclined toward the side. Hereby the watering is rendered more efficient, as at the aforesaid embodiments, which provides the prerequisites for an efficient cleaning of the roll surface. In order to increase still more the water distributing capacity of the mats, the mats preferably can be made of a water-absorbing material, and in order to increase the wear-resistance of the mats, their upper edge can be equipped with a wear bar, which preferably is provided with a number of grooves of tangential orientation communicating with the water-absorbing portion of the mat. In connection therewith it also is to be observed that one of the two mats in the embodiments according to FIGS. 11 and 12 can be abandoned in certain cases.

FIGS. 9 and 10 show a variant of the device according to the invention, at which the means for a uniform distribution of the water over the whole roll surface and for preventing water from flowing in axial direction out over the edges of the roll surface consist of pocket-forming arc-shaped ridges 21,23 which are arranged in several rows in the mat side abutting the roll surface and have apertures 22,24 for water passage which are located offset in relation to each other in the different rows, as also the ridges 21,23 shown in FIG. 9. The ridges 21 on one side of the central line of the mat bulge in one direction, and the ridges 23 on the other side of said central line bulge in the opposite direction, and constitute so to say their respective reflected images. The mat thereby acts equally efficiently in both driving directions. Said ridges 21,23 may also be given a shape of greater depth, for example U-shape or horseshoe-shape. Also this embodiment of the water distributing mat can be provided with a slit 7 according to the embodiment in FIGS. 1-3 or be used with the embodiment according to FIGS. 11 and 12.

The invention is not restricted to what is described above and shown in the drawings, but can be modified in many different ways within the scope of the claims. The slit 7, for example, must not lie in the centre of the plate as shown in the drawings, which position, however, has the advantage that the device according to the invention acts equally satisfactorily irrespective of the rotation direction of the roller roll, but the slit can lie offset relative to the centre and extend all the way out to the longitudinal edge of the mat. The position of the sprinkler tube, of course, must be adjusted to the position of the slit.

What I claim is:

1. A device for preventing material from adhering to the roll surface of a roller of a road roller, which comprises a water tank;

an apertured spray tube leading from the water tank to and above the roll surface and intermediate the edges of the latter; and at least one mat which abuts the roll surface and extends over the whole width thereof which mat is provided with means preventing water coming from the spray tube from flowing out in axial direction over the edges of the roll surface.

2. A device according to claim 1, in which said means consist of a slit with closed ends provided in the mat and extending over the greater part of the mat length, and in which the spray tube is located above said slit.

3. A device according to claim 2, wherein said slit consists of the intermediate space between two spaced mats provided with flaps facing toward each other at least at their ends.

4. A device according to claim 3 wherein said slit in both of its longitudinal surfaces is formed with pockets, preferably located between the apertures of the spray tube.

5. A device according to claim 2, in which the slit is provided with a water-absorbing and water-pervious material.

6. A device according to claim 1, in which the means consist of flaps projecting on at least one long side of the mat.

7. A device according to claim 1, in which the means consist of pocket-forming arc-shaped ridges in the mat side facing to the roll surface.

8. A device according to claim 7, wherein the ridges are arranged in several rows along the mat length, and apertures for water passage located therebetween are offset relative to each other in the different rows.

9. A device according to claim 7, wherein the arc-shaped ridges face in opposite directions on both sides of the central line of the mat.

10. A device according to claim 1, which further includes a holder acting as support means for the spray tube, the mat being connected to a metal sheet adapted to be inserted into said holder.

11. A device according to claim 1, in which the spray tube is divided into at least two separate sections, each section being connected to a water tank.

12. A device according to claim 1, wherein the spray tube comprises an inner tube and a number of sleeves mounted individually rotatable thereon, which sleeves together extend substantially over the whole length of the inner tube, the inner tube being provided with several rows of apertures of different sizes in the different rows of apertures, and the sleeves being provided with only one row of apertures whereby the water supply to the roll surface can be controlled individually between the different sections formed by the sleeves.

13. A device according to claim 1, wherein the mat is an assembly of pieces of an elastomer material presenting a coarse structure in the mat surface abutting the roll surface.

14. A device according to claim 13, in which chips of metal or the like are cast into the mat.

15. A device according to claim 1, in which the mat is made of a water-absorbing material.

* * * * *

UNITED STATES PATENT OFFICE

CERTIFICATE OF CORRECTION

Patent No. 4,040,762 Dated August 9, 1977

Inventor(s) MATS AKE NILSSON

It is certified that error appears in the above-identified patent and that said Letters Patent are hereby corrected as shown below:

[30] Foreign Application Priority Data

| | | |
|---|---|---|
| January 17, 1975 | Sweden | 7 500 490 |
| March 27, 1975 | Sweden | 7 503 596 |

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*